US006959879B2

(12) United States Patent
Laidler et al.

(10) Patent No.: US 6,959,879 B2
(45) Date of Patent: Nov. 1, 2005

(54) NOZZLE ARRANGEMENT

(75) Inventors: Keith Laidler, Stourbridge (GB); Andrew Yule, Derbyshire (GB)

(73) Assignee: Incro Limited, Stourbridge (GB)

( * ) Notice: Subject to any disclaimer, the term of this patent is extended or adjusted under 35 U.S.C. 154(b) by 0 days.

(21) Appl. No.: 10/276,063

(22) PCT Filed: May 10, 2001

(86) PCT No.: PCT/GB01/02036

§ 371 (c)(1),
(2), (4) Date: Jan. 31, 2003

(87) PCT Pub. No.: WO01/89958

PCT Pub. Date: Nov. 29, 2001

(65) Prior Publication Data

US 2003/0150937 A1 Aug. 14, 2003

(30) Foreign Application Priority Data

May 10, 2000 (GB) ..... 0011218

(51) Int. Cl.[7] ..... B05B 1/28; B05B 15/02; B05B 7/02

(52) U.S. Cl. ..... 239/104; 239/106; 239/115; 239/116; 239/526

(58) Field of Search ..... 239/104, 106, 239/115, 116, 526, 590, 600, 333, 337, 340, 349, 463, 472, 475; 222/402.1, 402.12, 402.13

(56) References Cited

U.S. PATENT DOCUMENTS

| | | | | |
|---|---|---|---|---|
| 3,648,932 A | | 3/1972 | Ewald et al. | |
| 3,767,125 A | | 10/1973 | Gehres et al. | |
| 3,870,205 A | | 3/1975 | Bucaro | |
| 4,145,005 A | | 3/1979 | Kirkel | |
| 5,335,857 A | * | 8/1994 | Hagon | 239/204 |
| 5,765,757 A | * | 6/1998 | Bendall | 239/205 |
| 5,884,845 A | | 3/1999 | Nelson | |
| 5,911,851 A | | 6/1999 | Bartels et al. | |
| 6,000,583 A | | 12/1999 | Stern et al. | |
| 6,367,711 B1 | * | 4/2002 | Benoist | 239/115 |

FOREIGN PATENT DOCUMENTS

| | | |
|---|---|---|
| GB | 2326607 | 12/1998 |
| WO | 97/31841 | 9/1997 |

OTHER PUBLICATIONS

Patent Abstracts of Japan, English abstract of JP 10174989, filed Jun. 22, 1998.

* cited by examiner

*Primary Examiner*—Davis Hwu
(74) *Attorney, Agent, or Firm*—Pillsbury Winthrop Shaw Pittman LLP

(57) ABSTRACT

A nozzle arrangement which is suitable for use in the generation of a spray or aerosol and which is adapted for connection to a fluid supply, the nozzle arrangement including a fluid inlet through which fluid enters the arrangement from the fluid supply and fluid outlet through which the fluid is ejected from the nozzle arrangement, fluid inlet and fluid outlet being connected to a fluid flow passage through which, in use, fluid flows from the inlet to the outlet, wherein the nozzle arrangement includes control means provided in the passage which, in use, acts to modify the flow characteristics of the fluid in the fluid flow passage to effectively control fluid droplet size produced in the spray or aerosol by the nozzle arrangement.

35 Claims, 12 Drawing Sheets

NOZZLE ARRANGEMENT

CROSS REFERENCE TO RELATED APPLICATIONS

This application is a National Phase application based on International Application No. PCT/GB01/02036, filed May 10, 2001. This application, in its entirety, is incorporated herein by reference.

This invention relates to improvements in or relating to a nozzle arrangement.

Nozzle arrangements are conventionally used to control the ejection of fluids from a pressurised container such as a so called "aerosol can" and can also be used in industrial apparatus to control the ejection of pressurised fluids in many different applications.

Conventional nozzle arrangements generally produce a spray or aerosol which comprises a fine mist of suspended fluid droplets whose size characteristics vary in accordance with a normal distribution.

Problems arise with conventional nozzle arrangements insofar as droplet diameters in the spray or aerosol produced can be below approximately 6.3 $\mu$m and droplets of such a size can be inhaled by any person in the vicinity of the spray or aerosol. This is a particular problem when considering nozzle arrangements on aerosol cans where in the case of, for example, a can of polish, paint, adhesive, deodorant or hairspray, components of the contents of the can can be toxic.

Problems also arise with conventional nozzle arrangements in which inhaling is not a problem in that it can be necessary to ensure that the droplets produced are of a preferred size to ensure the maximum effectiveness of the spray or aerosol for its intended purpose. Thus for example, for air fresheners it has been found that the smaller the droplet size the more effective the fragrancing. In this case, it is desirable that a maximum amount of droplets have a small droplet size to ensure effectiveness.

A further problem which arises with conventional nozzle arrangements arises when a compressed gas is used as a propellant in an aerosol can. Because a compressed gas "pushes" the contents out of a can rather than emerging with the droplets from the can as with other propellents such as liquid petroleum gas (LPG), the nozzle arrangement is more prone to blocking since the contents are not contained with a liquid propellent. A still further problem is that the average droplet size produced with a conventional nozzle using compressed gas as a propellent is approximately 80 $\mu$m whereas an average droplet size of approximately 30 $\mu$m is required. Further as the can empties, the pressure in the can decreases leading to an undesirable increase in average droplet size.

It is accordingly an object of the present invention to provide a nozzle arrangement in which the above mentioned problems are obviated or are at least minimised.

According to a first aspect of the invention there is provided a nozzle arrangement which is suitable for use in the generation of a spray or aerosol and which is adapted for connection to a fluid supply, the nozzle arrangement including a fluid inlet through which fluid enters the arrangement from the fluid supply and a fluid outlet through which the fluid is ejected from the nozzle arrangement, said fluid inlet and said fluid outlet being connected by a fluid flow passage through which, in use, fluid flows from the inlet to the outlet, wherein the nozzle arrangement includes control means provided in the passage which, in use, acts to modify the flow characteristics of the fluid in the fluid flow passage to effectively control fluid droplet size produced in the spray or aerosol by the nozzle arrangement.

With this arrangement it is possible to effectively control droplet size in a spray or aerosol produced by the nozzle arrangement thereby minimising problems of unwanted or undesirable inhaling of droplets and allowing maximisation of the effectiveness of the spray or aerosol for its intended purpose. Further, additionally, by controlling droplet size in the passage in conjunction with in the outlet, it permits compensation for the pressure drop which occurs in the arrangement when compressed gas is used as a propellant.

The control means preferably comprises one or more of the following:

a) an expansion means in which a dimension of the passage transversely to the direction of fluid flow is increased relative to the same dimension of the remainder of the passage;

b) inner orifice means in which the dimension of the passage transversely to the direction of fluid flow is decreased relative to the same dimension of the remainder of the passage;

c) a multiple channel means wherein at least a part of the passage is divided into from 2 to 12 channels each of which has a decreased dimension transversely to the direction of fluid flow relative to the same dimension of the remainder of the passage;

d) a dog leg means in which the flow through the passage is redirected in a direction substantially transversely to the direction of flow in the passage over the length of the means;

e) a swirl means wherein rotational flow is induced in the fluid about the direction of flow of fluid in the passage; and/or f) venturi means comprising a narrow passage broadening to a relative wide passage with a narrow air inlet entering the passage near the point at which the passage broadens.

It will be appreciated that any one or more of the above mentioned control means can be used as desired or as appropriate to suit the application in which the nozzle arrangement is being used and in particular multiple identical or similar types of the same control means may be used together in the same nozzle arrangement.

Preferably the expansion means is disposed adjacent said fluid outlet, furthermore said expansion means may form a chamber of substantially circular shape.

The nozzle arrangement may preferably have more than one fluid flow passage and in these circumstances the nozzle arrangement may have more than one fluid inlet and/or outlet. Where the nozzle arrangement has two or more passages, the arrangement preferably further includes a selection means at the, or each, fluid inlet which is operable to select through which of the fluid flow passages, the fluid flows. For example, the selection may be made according to the pressure or flow rate of the fluid. Where the nozzle arrangement has two or more fluid flow passages, the nozzle arrangement may comprise a fluid outlet for each fluid flow passage or, alternatively, the respective fluid flow passages may combine at a single fluid outlet.

Particularly advantageous results are obtained from the nozzle arrangement which includes a control means of the type a) and/or of the type b). Most advantageous results are obtained by inclusion of a control means of the type can a) and a control means b), the type a) control means being closest to the fluid outlet and the type b) control means being closest to the fluid inlet of the fluid flow passage.

For a nozzle arrangement for use with an aerosol or spray can containing a polish, paint, adhesive, deodorant or hairspray, control means a), b) and/or d) have been found to give particularly effective results. A nozzle arrangement which includes such control means in combination, preferably in the sequence d), b) and/or a) from the fluid inlet to the fluid outlet reduces the proportion of inhalable droplets in the aerosol or spray generated in use by the nozzle arrangement. In fact using this type of nozzle arrangement, the proportion of inhalable droplets in the aerosol or spray generated when the fluid supply is at maximum pressure, can be arrangement to be less than 15%, preferably arranged to be less than 10%, and most preferably less than 7% as measured by the method described below. It has further been found advantageous to include a throttle device before said control means type d) in this arrangement which throttle device reduces pressure in the flow and leads to an enhancement of the control of the fluid flow in subsequent control means types b) and a). Preferably the throttle device comprises a narrowing of the fluid flow passage.

For a nozzle arrangement for use with an aerosol can containing an air freshener or for a pharmaceutical application, it has been found that to give particularly effective results control means a), c) e) and/or f) can be used. This is because when they are used in a nozzle arrangement, the droplets of the spray produced by the nozzle arrangement are smaller and the droplet size distribution curve is narrower. The nozzle arrangement, in this case, preferably also has a narrower fluid outlet than in other embodiments. Furthermore, for this use, more than one fluid flow passage may be present and no selection means may be used to select the fluid flow passage through which fluid flows.

For a nozzle arrangement for use with an aerosol or spray can using a compressed gas propellent, the provision of more than one fluid flow passage has been found to be advantageous, and for example, two or three fluid flow passages may be used, each with a separate fluid outlet. The control means used in the fluid flow passages will vary according to the application of the aerosol or spray.

For a nozzle arrangement for use with an aerosol can containing an insecticide, preferably more than one fluid flow passage is used and it has been found that more than one fluid outlet is advantageous as are control means a) and b) or c).

For a nozzle arrangement for use in industry, it has been found that control means a), b), c), e) and f) can be used to generate a spray or aerosol with an average droplet size (as measured using the method described below) of less than 80 $\mu$m at a pressure of less than 20 bar and typically the average droplet size obtained would be 10 to 30 $\mu$m at a pressure of 2 to 5 bar. Being able to produce such a fine spray at a relatively low pressure is advantageous as it reduces the wear on the nozzle arrangement.

Preferably the fluid outlet of the nozzle arrangement is covered by a moveable hinged flap wherein, when in a closed position, affords protection to the fluid outlet.

The nozzle arrangement is preferably formed by at least two interconnected parts and the parts may be movable apart to enable cleaning of the nozzle arrangement to take place.

Most preferably, the nozzle arrangement is formed by two parts interconnected by a hinge to enable the parts to be moved towards and away from each other to enable cleaning to be effected.

Preferably one or both of said interconnected parts include a seal which when the parts are in the closed position prevents fluid in the nozzle arrangement from leaking out.

One advantage of manufacturing the nozzle arrangement in such a two part form is that it can be done very cheaply.

The actuator and spray-through cap according to the second and third in the aspects of the invention are optionally made either with the nozzle arrangement according to the invention forming an integral part of the constriction or alternatively the nozzle arrangement can be added subsequently as an attachment thereto.

In each of the control means of any of types a)–f), it may be possible to modify the flow of fluid in the control means advantageously by suitable adaption of an inner surface thereof. For example, a textured inner surface may be provided or alternatively projections e.g. spikes can be provided which induce turbulence into the fluid flow though the respective control means.

The invention will now be described further with reference to the accompanying drawings in which.

Figure 1:
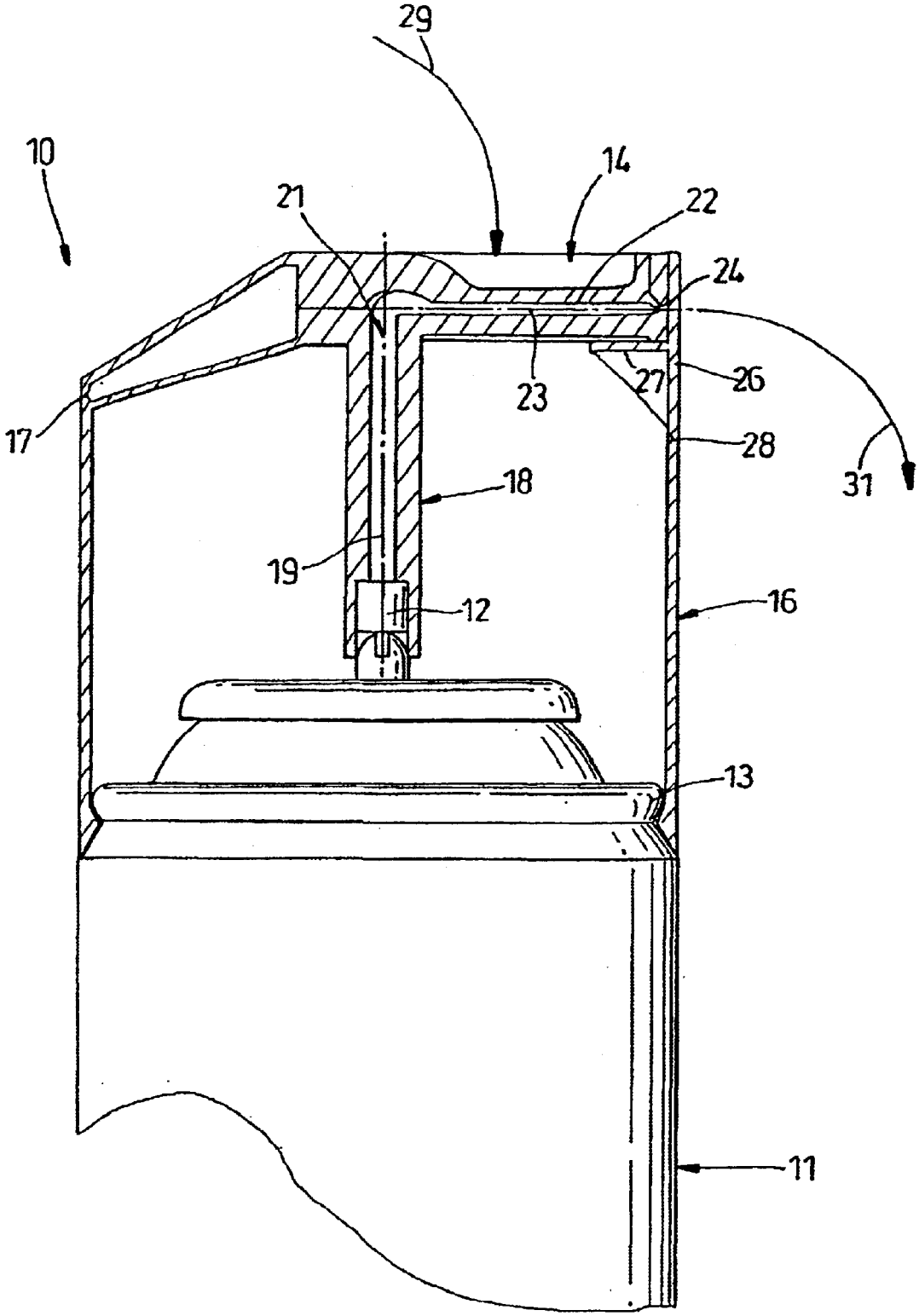
FIG. 1 is a side view partly in cross section showing a conventional spray-through cap mounted on a conventional pressured container.
Figure 2:
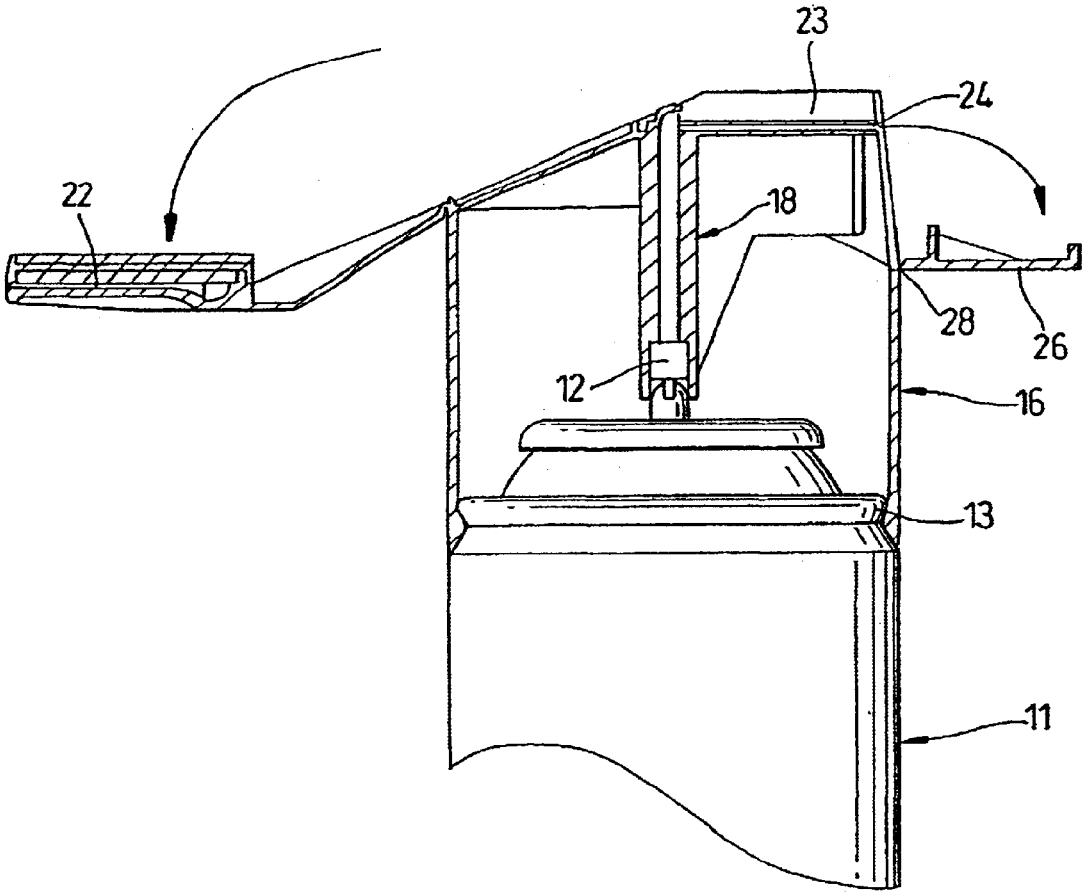
FIG. 2 is a side view partly in cross section of the spray-through cap of FIG. 1 in an "open" configuration.

Referring now to the drawings, there is shown in FIGS. 1 and 2 a conventional resilient spray-through cap 10 mounted on conventional canister 11 which contains fluid under pressure. The canister has an outlet 12 through which fluid under pressure can exit the canister 11 upon actuation. The cap 10 is mounted on the canister 11 by resilient engagement with a lip 13 on the canister 12.

The cap 10 is of two part form and comprises a closure 14 which is connected to a main body 16 by way of a resilient hinge 17. The cap 10 also includes a downwardly extending tubular member 18 which, when the cap 10 is mounted on the canister 11, engages with the outlet 12 to allow actuation thereof by depressing the cap downwards. The tubular member 18 has a bore 19 thereto which forms a part of a fluid flow passage 21. A lower surface of the closure 14 and an upper surface of the body 16 have respective grooves 22, 23 therein which, when the closure 14 is in a closed position, as shown in FIG. 1, define a part of the fluid flow passage 21. Then bore 19 of the tubular member 18 and the two grooves 22, 23 respectively in the lower surface of the closure 14 and upper surface of the body 14 form a fluid flow passage from the outlet 12 of the canister 11 to a fluid flow outlet 24 of the nozzle arrangement.

The body 16 of the cap also includes a hinged flap 26 which is shown in a closed position in FIG. 1. The flap 26 includes a projecting lip 27, which, when in closed position, prevents operation of the cap. The flap 26 when closed covers fluid outlet 24 and can be opened by pivoting around a hinge 28 which connects the flap 26 to the body 16. When open the fluid outlet 24 is exposed.

In use, the hinged flap 26 is opened to expose the fluid outlet 24 and then the upper surface of the closure 14 is depressed as illustrated by arrow 29. Depressing the top surface of the closure 14 causes tubular member 18 to actuate the canister outlet 12 releasing the fluid from the canister 11 into the fluid flow passage 21. The resilient nature of the cap 10 facilitates this action. Once released into the fluid flow passage 21, the pressurised fluid flows to the fluid outlet 24 and is ejected as indicated by arrow 31. Once used, the closure 14 can be opened by pivoting about the hinge 28 to enable cleaning of the grooves 22, 23 to take place.

Figure 3:
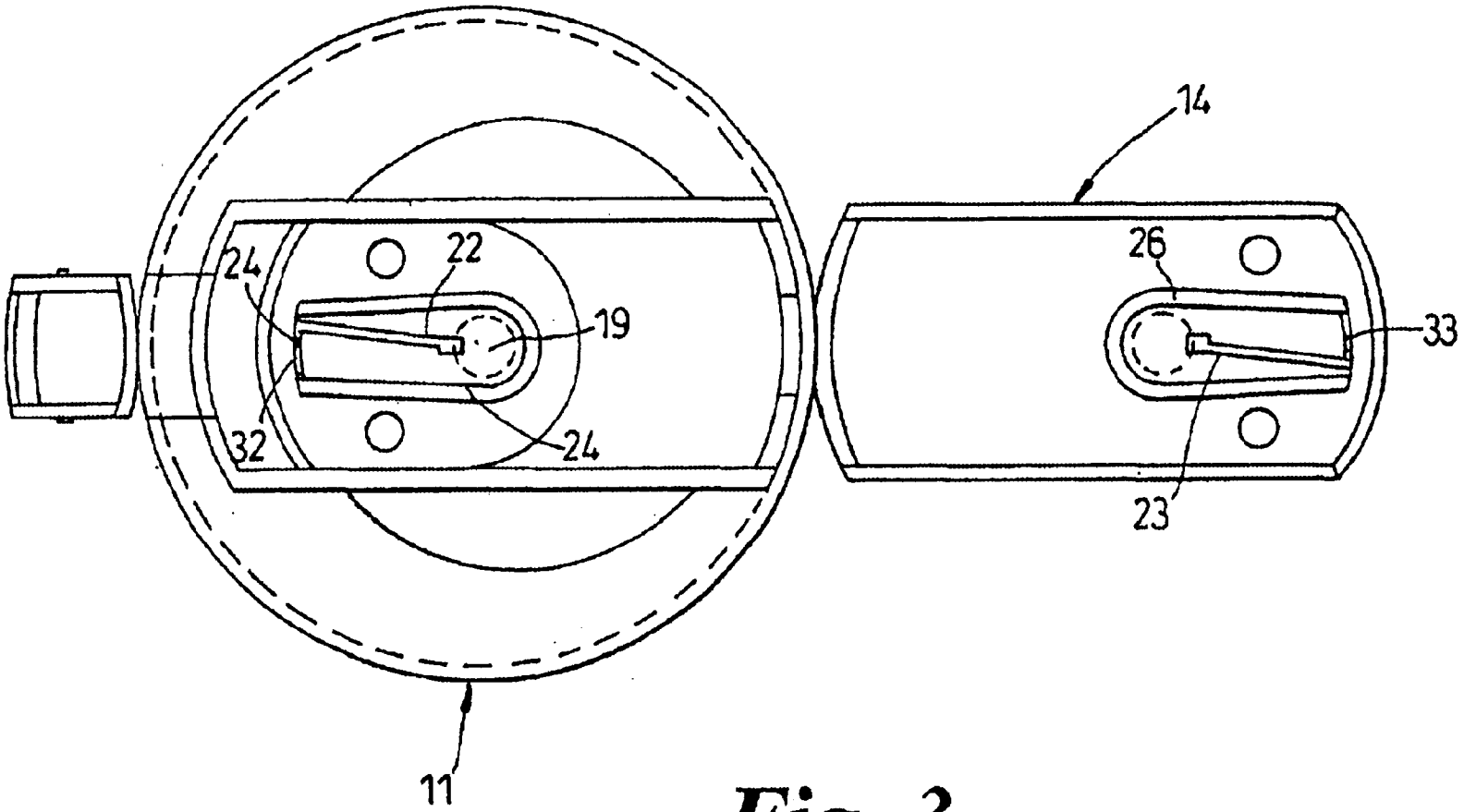
FIG. 3 is a plan view of the spray-through cap of FIG. 2.

FIG. 3 shows a plan view of the cap 10 of FIG. 1 and FIG. 2 and the same reference numerals have the same meaning as in FIGS. 1 and 2. The grooves 22, 23 respectively in the lower surface of the closure 14 and upper surface of the body 11 which form a part of fluid flow passage 21 are shown more clearly in this Figure. It can be seen that in a conventional cap, the grooves 22, 23 in the closure 14 and upper surface of the body 11 include portions 32, 33 which are transverse to the remainder of the grooves 22, 23 and which, when the closure 14 is in closed position (FIG. 1) form a swirl chamber which induces rotational movement in the fluid upon ejection from the fluid outlet 24. Each groove 22, 23 is surrounded by a horseshoe shaped seal 24, 26 which prevents fluid leaking from the nozzle arrangement.

Figure 4:
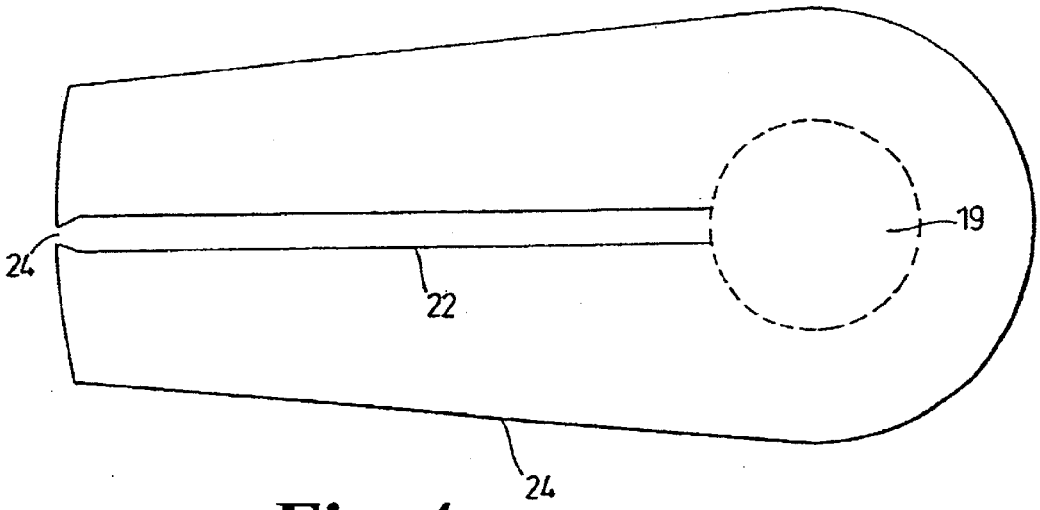
FIG. 4 is a cross-sectional view along X-X$^1$ of the conventional nozzle arrangement as shown in FIG. 2.

FIG. 4 shows a plan view of a part of a cap of the type shown in FIG. 3 in which there are no transverse portions to the grooves 22 (of which only the groove 22 in the body 11 is shown in the Figure) and therefore no swirl chamber is present. In use, a nozzle arrangement of the kind produces a spray with a full but uneven cone.

Figure 5:
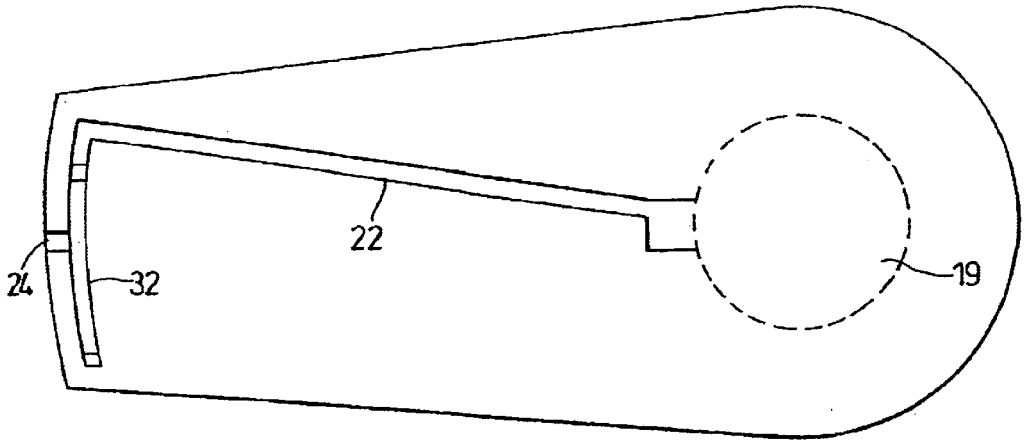
FIG. 5 is a cross-sectional view, similar to that of FIG. 4, of an alternative form of a conventional nozzle arrangement.

FIG. 5 shows a plan view of a part of the cap of FIG. 3 showing more clearly the transverse portion 32 of the groove 22 on the upper surface of the body 11. In use, a nozzle arrangement as illustrated in FIG. 5 produces a spray with a hollow cone.

Figure 6:
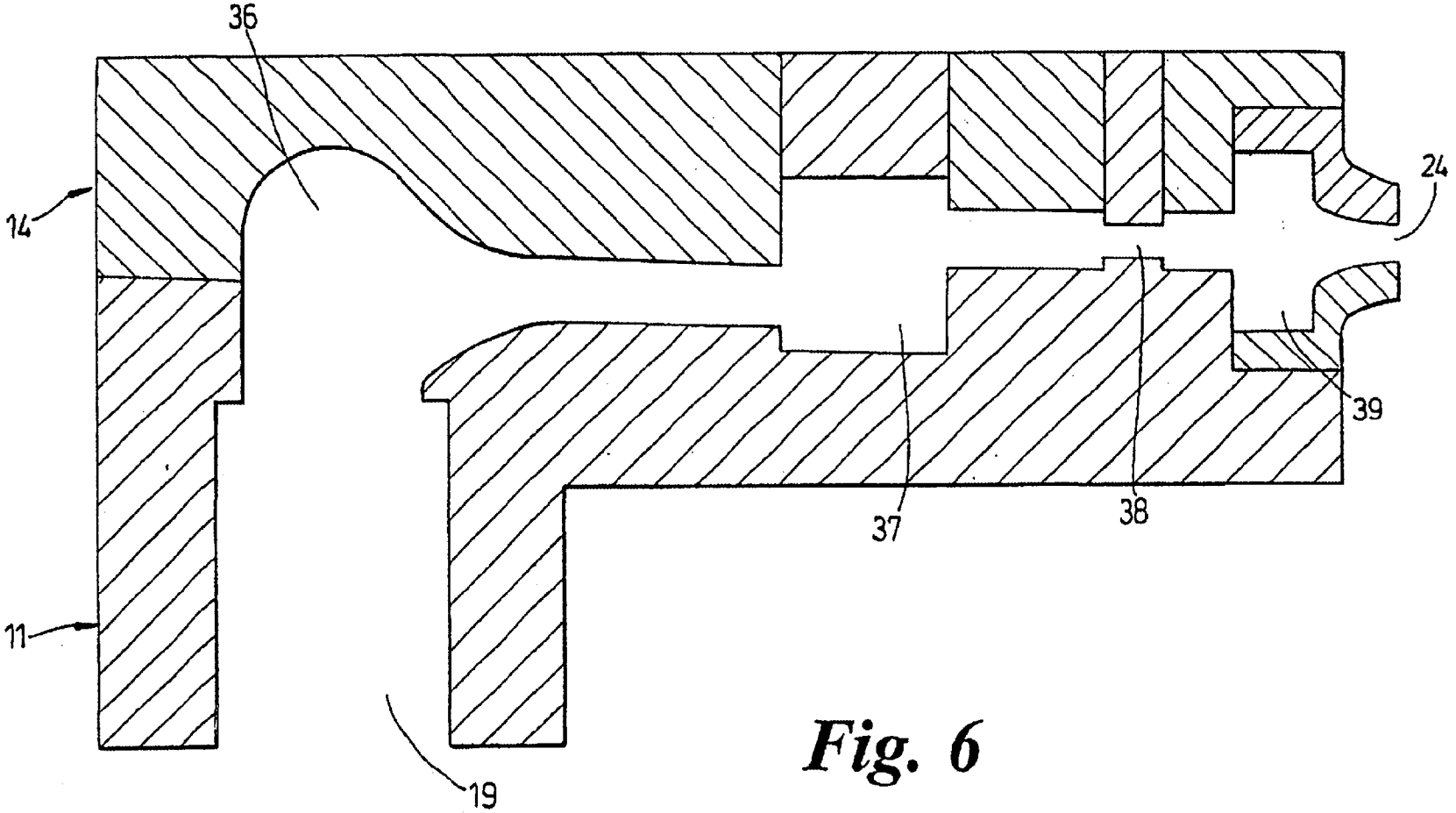
FIG. 6 is a, side view, in cross section, of a part of a fluid flow passage of a first embodiment of nozzle arrangement according to the invention.

FIG. 6 shows a first embodiment of nozzle arrangement in accordance with the present invention. The Figure represents a cross section through the closure 14 and body 11 of a cap 10 of the type shown in FIG. 1. Only a part of the tubular member 18 is shown for clarity. In the first embodiment of the invention, the fluid flow passage 21 is modified to control the characteristics of the aerosol produced from fluid outlet 24. The passage comprises a first chamber 36, a dog leg 37, an inner orifice 38, an expansion chamber 39 and a constricted nozzle arrangement outlet 24. The first chamber 36 has smooth curved walls thereto which assist in the prevention of the formation of fluid droplets of inhalable size. Conventional nozzle arrangements, where they have such a chamber due to the manner of manufacture have a uneven surface which increases the likelihood of smaller inhalable droplets being formed. The dog leg 37 also acts to reduce the quantity of inhalable droplets and also reduces the effects of any variation in distance between the chamber 36 and outlet 24 which can occur with different size aerosol cans. The inner orifice 38 forms a spray in the passage 21 and the spray mixes with the spray from the outlet 24 to cause smaller droplets to coalesce such that small inhalable droplets are reduced. The spray formed at orifice 38 is spinning and spins with in the expansion chamber 39 which acts to form an even spray when this emerges from outlet 24. The distance between chamber 39 and outlet 24 can be carried to achieve a desired angle of spray from the outlet 24.

It has been found that, in use, a nozzle arrangement with the combination of control modifications illustrated in FIG. 6 produces an aerosol or spray where the average proportion over the lifetime of the aerosol of droplets having a diameter below 6.3 $\mu$m (as measured using the technique described below) is reduced from 25% (for a normal nozzle arrangement such as that illustrated in FIG. 5) to below 6.5%.

Figure 7:
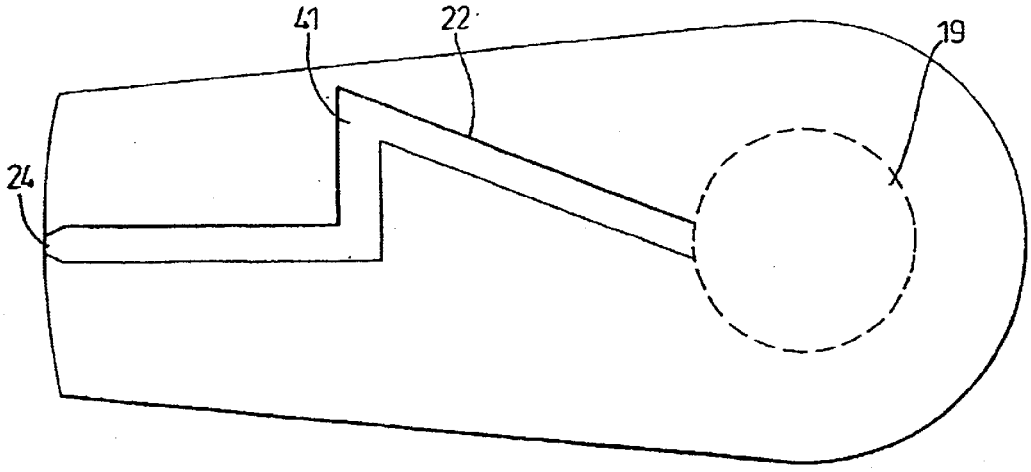
FIG. 7 is a, side view, in cross section, of a part of a fluid flow passage of a second embodiment of nozzle arrangement according to the invention.

FIG. 7 shows a plan view of part of a second embodiment of nozzle arrangement according to the invention. The fluid flow passage 21 in this embodiment is modified by the presence of a dog leg 41. The dog leg 41 assists in negating any effect the dimensions of the nozzle arrangement has on the droplet distribution in the spray. In use, a nozzle arrangement as illustrated in FIG. 7 is advantageous because the lower tail of the droplet distribution curve is minimised such that the number of droplets having a diameter less than 10 $\mu$m and particularly 6.3 $\mu$m is reduced.

Figure 8:
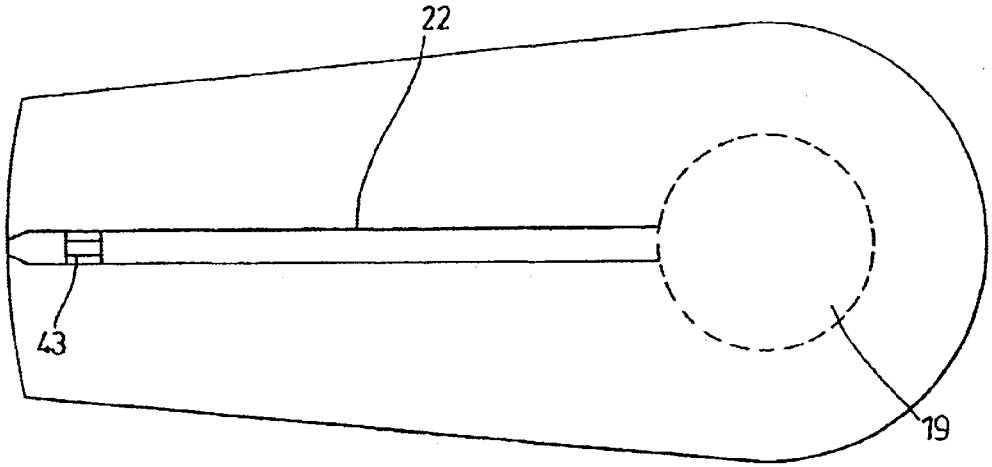
FIG. 8 is a, side view, in cross section, of a part of a fluid flow passage of a third embodiment of nozzle arrangement according to the invention.

FIG. 8 shows a plan view of a part of a third embodiment of nozzle arrangement according to the invention. In this embodiment, the fluid flow passage 21 is modified by the inclusion of an inner orifice 43 adjacent the fluid outlet 24. The advantage of the orifice 43 is that it can be used to control the rate of flow through the nozzle arrangement. Normally outlet 24 performs this function. When an orifice 43 is present, outlet 24 can be enlarged to reduce the number of droplets having a diameter less than 6.3 $\mu$m without increasing the flow rate. The distance between orifice 43 and outlet 24 has also been found to affect the shape of the droplet size distribution curve. A further advantage is that a nozzle arrangement which includes an orifice 43 is more likely to produce a spray with an even full cone since the orifice 43 acts to fill in the spray with droplets thus producing a full cone.

Figure 9:
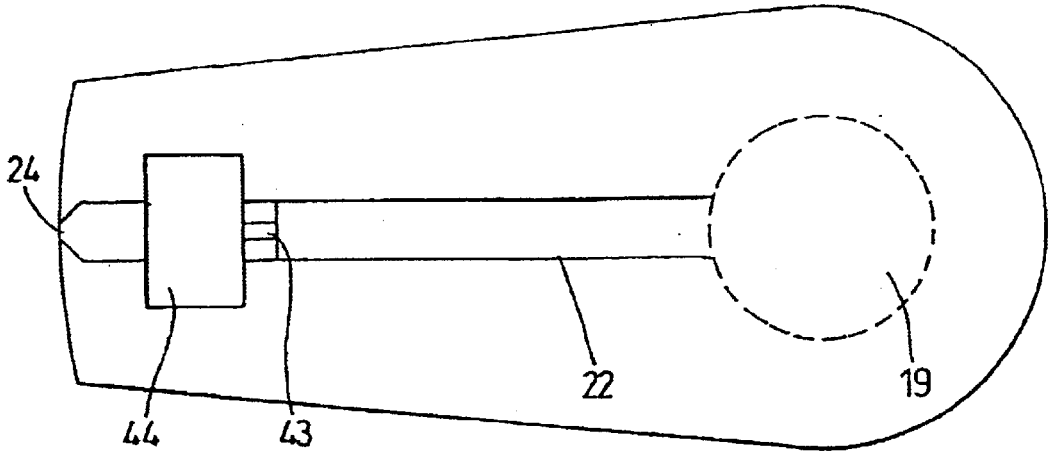
FIG. 9 is a, side view, in cross section, of a part of a fluid flow passage of a fourth embodiment of nozzle arrangement according to the invention.

FIG. 9 shows a plan view of part of a fourth embodiment of nozzle arrangement according to the invention. In this embodiment, the fluid flow passage 21 is modified by the inclusion of an inner orifice 43 followed by an expansion chamber 44. In this embodiment, the expansion chamber 44 enables the effects of the inner orifice 43 described in relation to FIG. 8 to be enhanced.

Figure 10:
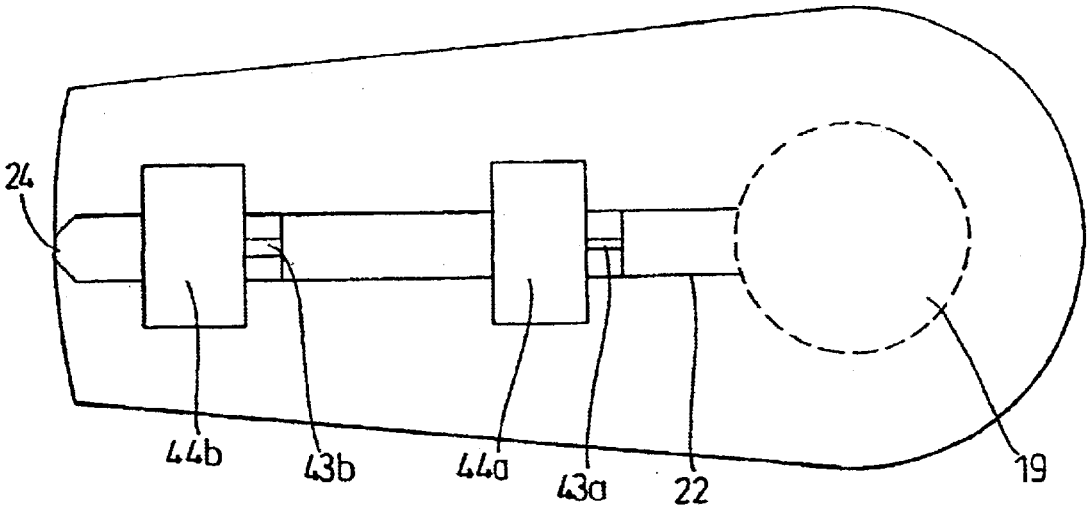
FIG. 10 is a, side view, in cross section, of a part of a fluid flow passage of a fifth embodiment of nozzle arrangement according to the invention.

FIG. 10 shows a plan view of part of a fifth embodiment of nozzle arrangement according to the invention. In this embodiment, fluid flow passage 21 is modified by the inclusion of two combinations of a orifice (43*a* and 43*b*) and an expansion chamber (44*a* and 44*b*). This arrangement has the advantages o the arrangement of FIG. 9 but because o the use of two combinations the effect achieved is enhanced.

Figure 11:
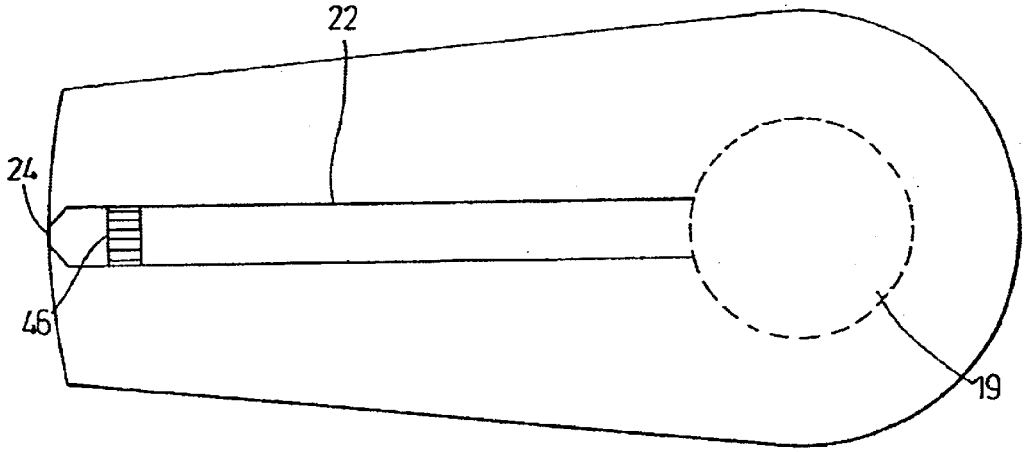
FIG. 11 is a, side view, in cross section, of a part of a fluid flow passage of a sixth embodiment of nozzle arrangement according to the invention.

FIG. 11 shows a plan view of part of a sixth embodiment nozzle arrangement according to the invention. In this embodiment, fluid flow passage 21 is modified by having a restrictor 46 in the form of a perforated body which has a number of very fine holes. The advantage of the restrictor 46 is that the average droplet size in the aerosol or spray produced, in use, from a nozzle arrangement illustrated in FIG. 9 is reduced. As an alternative the restrictor 46 could be replaced by a very fine slit to achieve the same effect.

Figure 12:
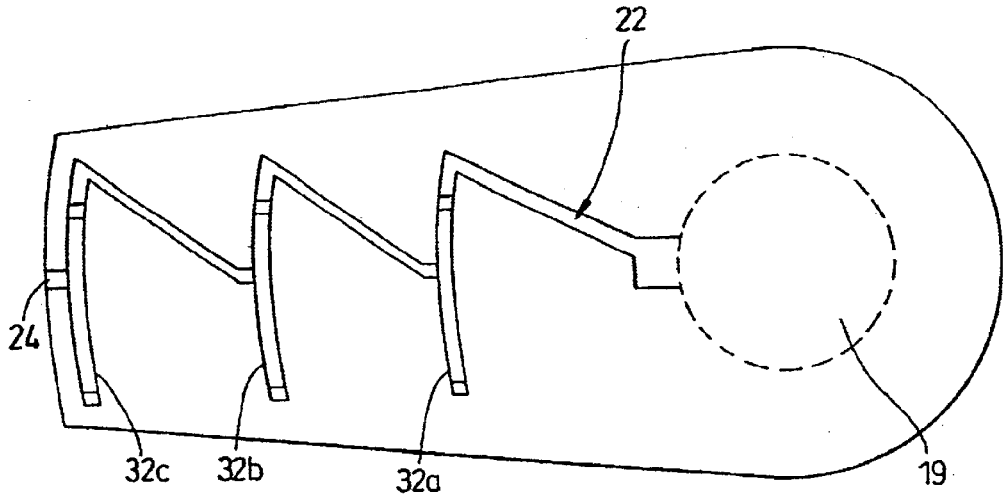
FIG. 12 is a, side view, in cross section, of a part of a fluid flow passage of a seventh embodiment of nozzle arrangement according to the invention.

FIG. 12 shows a plan view of a part of a seventh embodiment of nozzle arrangement according to the invention. In this embodiment, fluid flow passage 21 is modified by the inclusion of a number of swirl chambers 32*a,* 32*b* and 32*c.* In the drawing three such swirl chambers are shown although it is possible for one to four such chambers to be used. Advantages of the nozzle arrangement illustrated in FIG. 12 include that the spray produced will be well mixed and have a lower average droplet size. This arises because the swirling action results in the product contained in the can being broken up to a greater extent.

Figure 13:
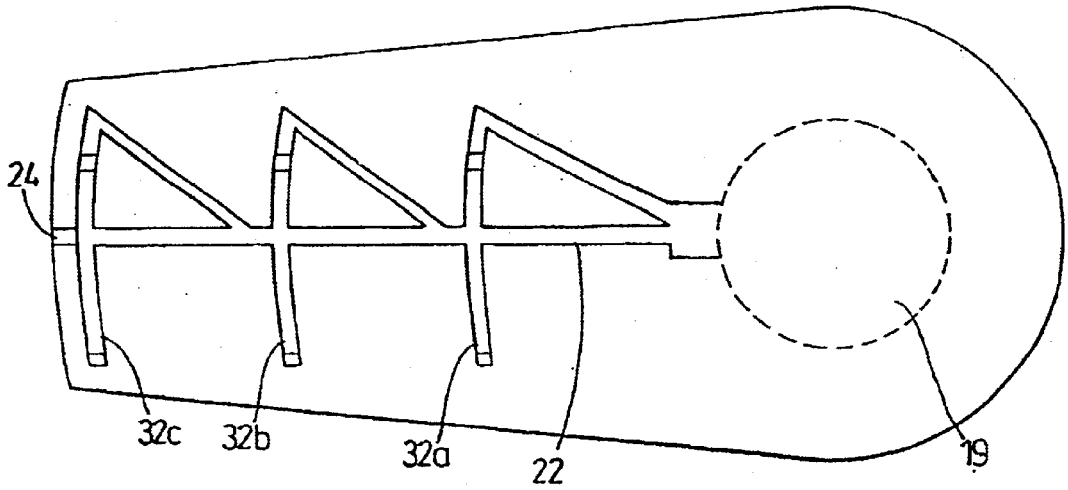
FIG. 13 is a, side view, in cross section, of a part of a fluid flow passage of a eighth embodiment of nozzle arrangement according to the invention.

FIG. 13 shows a plan view of a part of a eighth embodiment of nozzle arrangement according to the invention. In this embodiment, fluid flow passage 21 is modified by, at three points along its length, the fluid flow passage 21 connects to three swirl chambers 32*a,* 32*b* and 32*c* each of which reconnects to the fluid flow passage 21. One advantage of a nozzle arrangement provided with such a passage 21 is that the upper tall of the droplet size distribution curve of the droplets in the spray or aerosol produced by such a nozzle arrangement is minimised. A further advantage is that the spray produced will have a full cone because of the continuous length of the passage 21.

Figure 14:
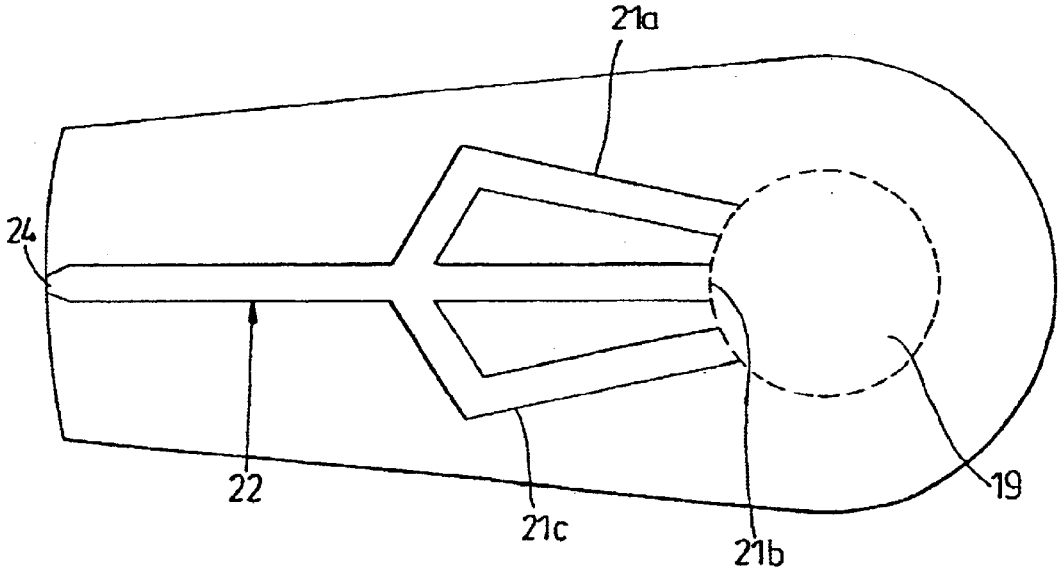
FIG. 14 is a, side view, in cross section, of a part of a fluid flow passage of a ninth embodiment of nozzle arrangement according to the invention.

FIG. 14 shows a plan view of a part of a ninth embodiment of nozzle arrangement according to the invention. In this embodiment, fluid flow passage 21 is modified in that it has three arms 21*a,* 21*b* and 21*c* which connect to the bore of the tubular member 19. The three arms 21*a,* 21*b* and 21*c* are arranged so that as the pressurised canister empties and the pressure decreases in the canister, the contents of the container when the canister is used flow down different arms. The arms 21*a,* 21*b* and 21*c* have different configurations so as to cause different effects on the flow of the contents. By having different configurations is meant that each arm 21*a,* 21*b* and/or 21*c* includes appropriate means to modify the flow characteristics of the fluid to ensure that the droplet distribution where the arms recombine to foam passage 21 is the same throughout the life of the canister. This is particularly important when the propellent is compressed gas where usually the droplet distribution will vary enormously during can life. Arms 21*a,* 21*b* and 21*c* need not necessarily combine to reform passage 21. Instead they may lead either together or independently to separate nozzle arrangement outlets.

Figure 15:
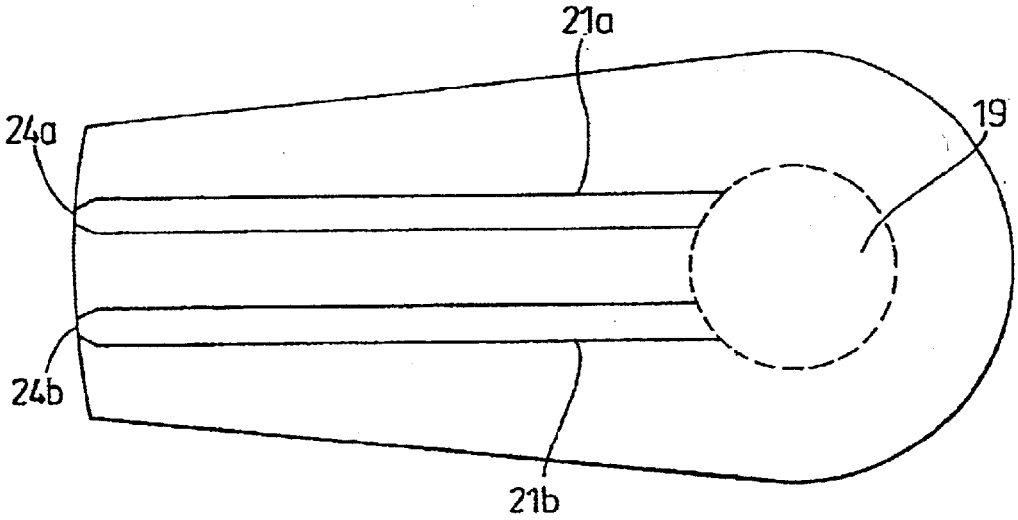
FIG. 15 is a, side view, in cross section, of a part of a fluid flow passage of a tenth embodiment of nozzle arrangement according to the invention.

FIG. 15 shows a plan view of a part of a tenth embodiment of nozzle arrangement according to the invention. In this embodiment, the fluid flow passage 21 is divided into two arms 21*a,* 21*b.* The arms 21*a* and 21*b* lead from tubular connector 9 to separate fluid outlets 24*a* and 24*b,* respectively.

The nozzle arrangement illustrated in FIG. 15 is advantageous in an air freshener application because the outlets 24*a* and 24*b* could be constricted to produce droplets of a smaller size. The reduction in the flow rate caused by having two arms 21*a* and 21*b* would be compensated for by having two outlets.

The nozzle arrangement illustrated in FIG. 15 is also advantageous for use with a compressed gas aerosol if it is provided with a pressure activated means which determines which of passages 21*a* and 21*b* the fluid flows through. To prevent deterioration of the spray characteristics as the pressure in the can drops, flow is switched from one passage to the other when the pressure falls below a predetermined level. Each of the arms 21*a* or 21*b* can be modified in any desired appropriate way to modify the characteristics of the aerosol produced by the nozzle arrangement and the modification can be such that the modification to one arm is suitable to work at higher pressures and the modification to the other arm is suitable to work at lower pressures.

Whilst in the embodiments of FIGS. 14 and 15 two or three arms 21*a,* 21*b* and 21*c* are provided, it will be appreciated that any number of arms, as desired or as appropriate can be used. Preferably the number of arms is in the range of 2 to 4.

Figure 16:
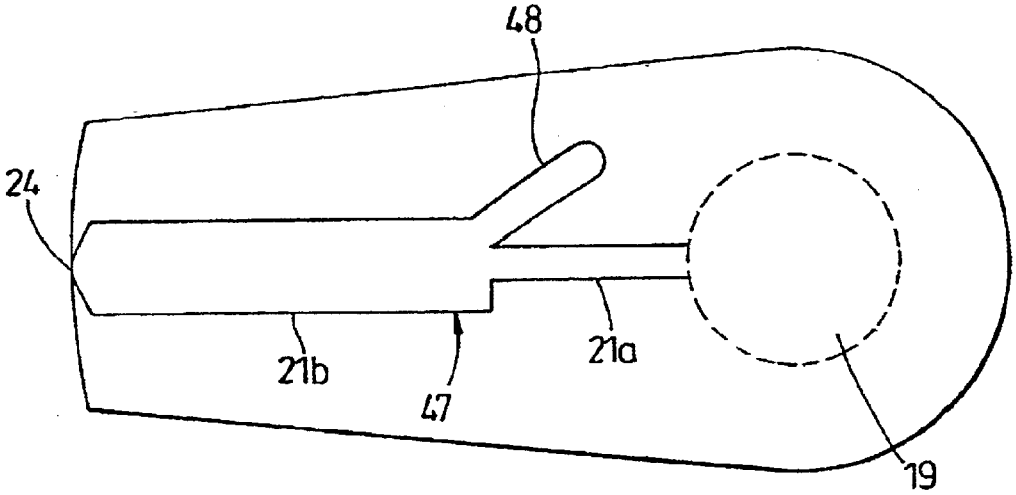
FIG. 16 is a, side view, in cross section, of a part of a fluid flow passage of a eleventh embodiment of nozzle arrangement according to the invention.

FIG. 16 shows a plan view of a part of an eleventh embodiment of nozzle arrangement according to the invention. In this embodiment, fluid flow passage 21 is modified by the inclusion of a venturi arrangement 47. Passage 21 is initially narrow 21*a* and broadens 21*b* at the point where a passage 48 joins to form the venturi arrangement. Passage 48 leads to a vent in the nozzle arrangement (not shown) and thus provides the venturi arrangement with an air inlet. The advantage of such a nozzle arrangement is that the air flow from passage 48 helps to break up the aerosol leading to a reduction in the average droplet size. This has been found to be useful with compressed gas aerosol cans.

Figure 19:
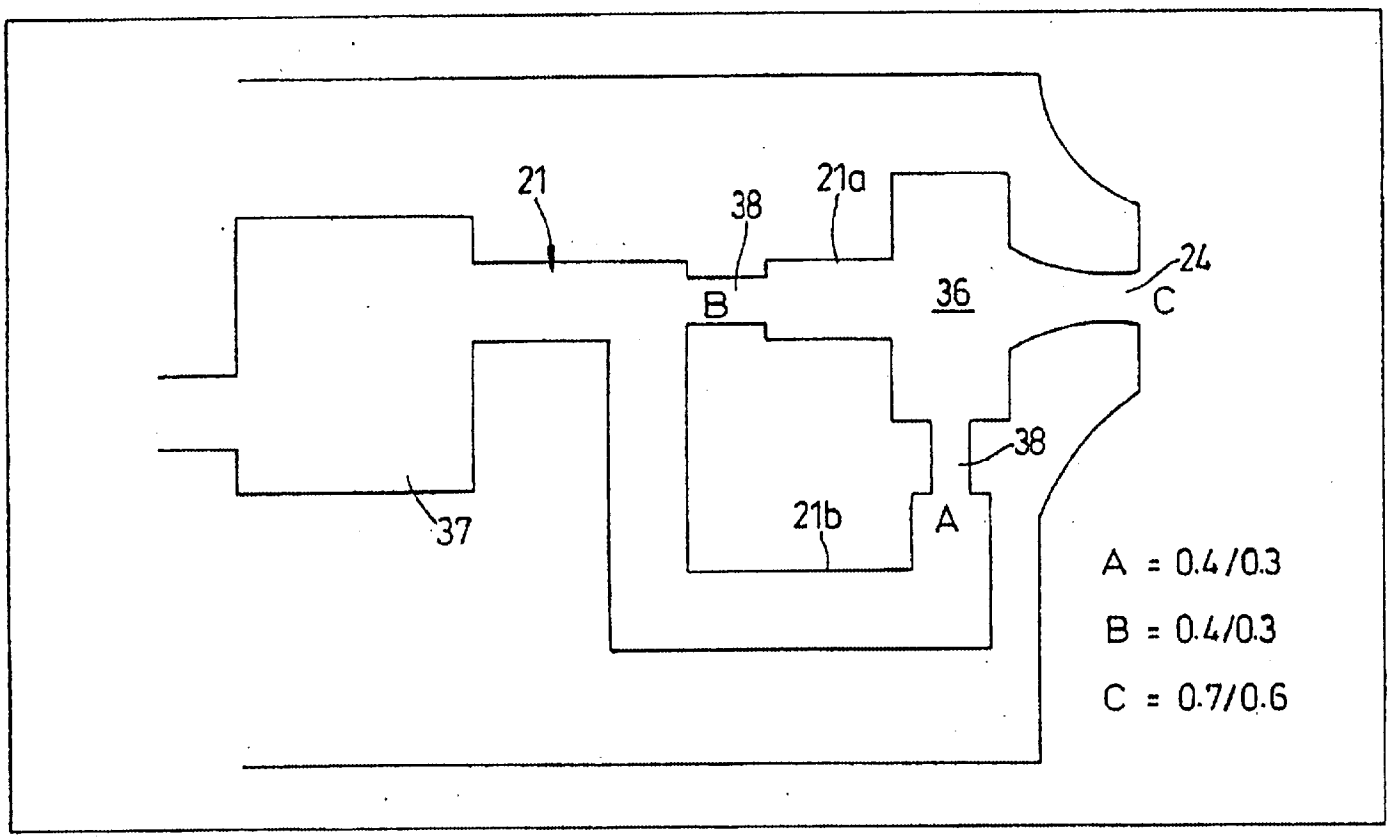

FIG. 19 shows a twelfth embodiment of nozzle arrangement according to the present invention. This arrangement includes an inner orifice 38, expansion chamber 36 and dog leg 37 in the fluid flow passage 21 linked to fluid outlet 24. Between the dog leg 37 and the inner orifice 38, the fluid flow passage 21 splits into two parts, a first part 21*a* and a second part 21*a* which respectively deliver fluid to the expansion chamber 36, the fluid from the second part 21*b* flowing into the expansion chamber 36 substantially perpendicularly to the fluid flowing from the first part 21*a* into the expansion chamber 36. If desired, a further inner orifice can be provided in the second part 21*b* and indeed one or more further inner orifices 38 can be provided in either or both of the first or second parts 21*a* and 21*b* respectively. The advantage of this construction is that the effect of the two perpendicular fluid flows into the expansion chamber 36 causes the fluid to spin in the expansion chamber 36 which reduces the size of droplets in the fluid. The impact of the two fluid flows in the expansion chamber also assists this respect. As an alternative, the second part 21*b* can be arranged to part fluid to flow therefrom into the expansion chamber 36 substantially tangentially.

Figure 17:
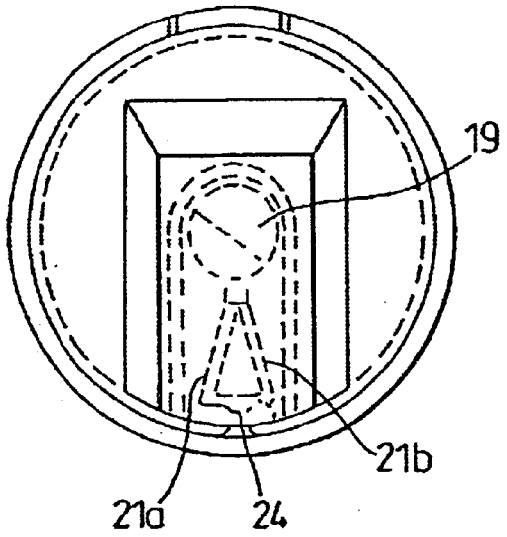
FIG. 17 is a plan view of a conventional industrial nozzle arrangement.
Figure 18:
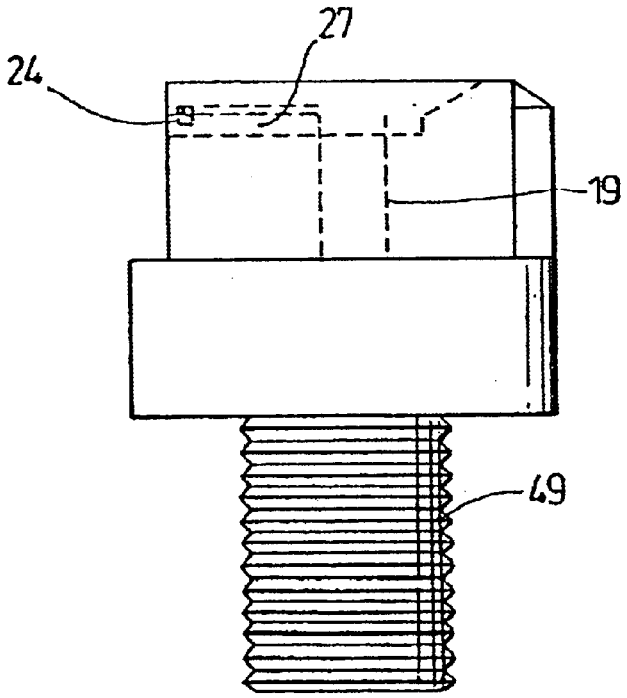
FIG. 18 shows a side elevation of a conventional industrial nozzle arrangement.

Whilst the above embodiments of nozzle arrangement have been described for use with pressurised canisters, it will be appreciated that the nozzle arrangement of the invention can also be used in an industrial nozzle arrangement which is also used to produce fluid spray or aerosols having particular properties. FIGS. 17 and 18 show embodiments of industrial nozzle in which a nozzle arrangement of the kind of the present invention is present. Thus, as shown in FIG. 18, a fluid supply pipe 49 supplies fluid under pressure to a fluid flow passage 21 of the type mentioned in relation to the other embodiments and the fluid flow passage can be modified in any of the ways mentioned above in relation to the other embodiments to achieve any of the desired effects in the spray or aerosol produced by the nozzle arrangement. In an industrial nozzle arrangement, compressed air can be added to the fluid either at the fluid inlet, fluid outlet or any part of the fluid flow passage as desired or as appropriate.

It will be appreciated that, as mentioned above, there are many ways of modifying the fluid flow passage and each of these ways can be utilised separately or in combination with one or more other ways. In fact, the modifications necessary are chosen dependent on the desired properties of the spray or aerosol produced by the nozzle arrangement.

Droplet size and distribution curves were measured using a Malvern Instruments ST1600 Laser Diffraction instrument. Measurements were made at about 150 mm from its orifice, with the laser beam traversing the cross-section of the spray. A 210 mm focal length lens was used, giving a measurable particle size range $0.5 \leqq D \leqq 188$ microns. When testing a nozzle arrangement, the aerosol can was first weighted and measurements were made for the full can (0% discharged) and typically 25%, 50%, 75% and 95% discharged. Flow rate was measured as a function of the percentage discharged, by the timed discharge of a measured mass (obtained by weighing the can). Spray angle was obtained by spraying onto a steel rule at a distance of 40 mm downstream, and visual inspection of the deposition.

It is of course to be understood that the invention is not intended to be restricted to the details of the above embodiment which are described by way of example only.

Thus, for example, as a alternative to using compressed gas or propellant to activate the nozzle arrangement of the invention, a pump mechanism of any suitable form can be used.

What is claimed is:

1. A nozzle arrangement which is suitable for use in the generation of an atomized spray or aerosol and which is adapted for connection to a fluid supply, the nozzle arrangement comprising a fluid inlet through which fluid enters the arrangement from the fluid supply and a fluid outlet through which the fluid is ejected from the nozzle arrangement, said fluid inlet and said fluid outlet being connected by a fluid flow passage through which, in use, fluid flows from the inlet to the outlet, the nozzle arrangement including control means provided in the passage and which, in use, acts to control the fluid droplet size in the spray or aerosol produced by the nozzle arrangement at the outlet, the control means including, in order from the inlet to the outlet, a first constriction means, a first expansion means associated with the first constriction means, a second constriction means and a second expansion means associated with the second constriction means, each constriction means comprising a region of the passage in which a dimension of the passage taken in a direction transverse to the direction of fluid flow is smaller than the equivalent dimension of a portion of the passage immediately upstream from the respective constriction means, each expansion means comprising a region of the passage in which at least a first dimension of the passage taken in a direction transverse to the direction of fluid flow is larger than the equivalent dimension of a portion of the passage immediately upstream from the respective expansion means and said expansion means forms a chamber, each constriction means being adapted to generate, in use, a spray of the fluid within its associated expansion means.

2. A nozzle arrangement according to claim 1, wherein at least one of the constriction means comprises an inner orifice means.

3. A nozzle arrangement according to claim 1, wherein at least one of the constriction means comprises a multiple channel means to modify the size of the spray droplets produced, at least a part of the passage is divided into from two to twelve channels each of which has a decreased dimension transversely to the direction of fluid flow relative to the same dimension of the remainder of the passage.

4. A nozzle arrangement according to claim 3, wherein the multiple channel means comprises a restrictor having a perforated body with a number of holes there through.

5. A nozzle arrangement according to claim 1, wherein each expansion means is closer to the fluid outlet than its respective constriction means.

6. A nozzle arrangement according to claim 1, wherein said fluid flow passageway further comprises further control means additional to said first and second expansion means and said first and second constriction means.

7. A nozzle arrangement according to claim 6, wherein said additional control means comprises at least one further expansion means.

8. A nozzle arrangement according to claim 7, wherein at least one further constriction means is arranged in combination with the at least one further expansion means, with the at least one further expansion means being closest to the fluid outlet and the at least one further constriction means being closest to the fluid inlet.

9. A nozzle arrangement according to claim 6, wherein said additional control means comprises at least one further constriction means.

10. A nozzle arrangement according to claim 9, wherein said at least one further constriction means is a further inner orifice means.

11. A nozzle arrangement according to claim 9, wherein said at least one further constriction means comprises a further multiple channel means.

12. A nozzle arrangement according to claim 6, wherein said additional control means comprises at least one dog leg means to modify the size of the spray droplets produced, wherein the flow through the passage is redirected in a direction generally transverse to the direction of flow in the passage over the length of the means.

13. A nozzle according to claim 12, wherein the at least one dog leg means comprises an expansion chamber in which the inlet and outlet are offset relative to one another.

14. A nozzle arrangement according to claim 6, wherein said additional control means comprises at least one swirl means to modify the size of the spray droplets produced, wherein rotational flow is induced in the fluid about the direction of flow of fluid in the passage.

15. A nozzle arrangement according to claim 14, wherein from the fluid inlet to the fluid outlet, said fluid passage comprises in the following order, a swirl means, an inner orifice means, and an expansion means.

16. A nozzle arrangement according to claim 6, wherein said additional control means comprises at least one venturi means which further comprises a narrow passage broadening to a relatively wide passage with a narrow air inlet entering the passage near the point at which the passage broadens.

17. A nozzle arrangement according to claim 1, wherein at least one of the constriction means is positioned adjacent to a respective one of the expansion means such that, in use, said constriction means generates a spray of the fluid passing through the fluid flow passage within said expansion means.

18. A nozzle arrangement according to claim 1, wherein an expansion means is provided adjacent said fluid outlet.

19. A nozzle arrangement according to claim 1, wherein at least one of said expansion means forms a chamber of substantially circular cross-section.

20. A nozzle arrangement according to claim 1, wherein at least one of said expansion means is provided with a projection on an inner surface thereof to induce turbulence in the fluid flow.

21. A nozzle arrangement according to claim 1, wherein the fluid outlet is covered by a movable hinge flap which, when in a closed position, affords protection to the fluid outlet.

22. A nozzle arrangement according to claim 1, wherein the nozzle arrangement is formed by at least two interconnected parts and the parts are movable apart to enable cleaning of the nozzle arrangement.

23. A nozzle arrangement according to claim 22, wherein the nozzle arrangement is formed in two parts interconnected by a hinge to enable the parts to be moved towards and away from each other.

24. A nozzle arrangement according to claim 22, wherein one or both of said interconnected parts includes a seal which when the parts are brought together to form the nozzle arrangement prevent fluid in the nozzle arrangement from leaking out.

25. A nozzle arrangement according to claim 1, wherein the nozzle arrangement has more than one fluid flow passage.

26. A nozzle arrangement according to claim 25, wherein the nozzle arrangement includes a selection means at the, or each, fluid inlet which is operable to select through which of the fluid flow passages the fluid flows.

27. A nozzle arrangement according to claim 26, wherein the selection means operates to select which of the fluid flow passages the fluid flows through according to the pressure of the fluid.

28. A nozzle arrangement according to claim 25, wherein the nozzle arrangement comprises a fluid outlet for each fluid flow passage.

29. A nozzle arrangement according to claim 25, wherein each respective fluid flow passage combines at a single fluid outlet.

30. A nozzle arrangement according to claim 25, wherein the nozzle arrangement comprises at least two fluid flow passages each with a separate fluid outlet.

31. A nozzle arrangement according to claim 25, wherein the nozzle arrangement includes three or more fluid flow passages.

32. A nozzle arrangement according to claim 1, wherein the nozzle arrangement has more than one fluid inlet and/or fluid outlet.

33. A nozzle arrangement according to claim 1, wherein at least one of the constriction is in the form of a slit.

34. A nozzle arrangement as claimed in claim 1, wherein each of said expansion means comprises a region of the passage in which a second dimension of the passage taken in a direction transverse to the direction of fluid flow is larger than the equivalent dimension of a portion of the passage immediately upstream from the respective expansion means, said second dimension being perpendicular to said first dimension.

35. A nozzle arrangement according to claim 1, wherein the nozzle arrangement is configured for use with fluids at a pressure of less than 20 bar.

* * * * *